US010363649B2

(12) United States Patent
Hyust et al.

(10) Patent No.: US 10,363,649 B2
(45) Date of Patent: Jul. 30, 2019

(54) MULTI-FUNCTIONAL WRENCH

(71) Applicant: KIRK WRENCH LLC, Canton, OH (US)

(72) Inventors: Kirk W. Hyust, Canton, OH (US); Karl H. Beitzel, Canton, OH (US)

(73) Assignee: KIRK WRENCH LLC, Canton, OH (US)

( * ) Notice: Subject to any disclaimer, the term of this patent is extended or adjusted under 35 U.S.C. 154(b) by 173 days.

(21) Appl. No.: 15/217,622

(22) Filed: Jul. 22, 2016

(65) Prior Publication Data

US 2018/0021929 A1 Jan. 25, 2018

(51) Int. Cl.

| | |
|---|---|
| ***B25G 1/04*** | (2006.01) |
| ***B25B 23/00*** | (2006.01) |
| ***B25B 13/46*** | (2006.01) |
| ***B25B 13/48*** | (2006.01) |
| ***B25G 1/06*** | (2006.01) |
| ***B25G 1/10*** | (2006.01) |
| ***B25G 3/06*** | (2006.01) |

(Continued)

(52) U.S. Cl.

CPC ..... *B25B 23/0028* (2013.01); *B25B 13/04* (2013.01); *B25B 13/08* (2013.01); *B25B 13/16* (2013.01); *B25B 13/461* (2013.01); *B25B 13/462* (2013.01); *B25B 13/481* (2013.01); *B25B 23/0007* (2013.01); *B25G 1/043* (2013.01); *B25G 1/063* (2013.01); *B25G 1/105* (2013.01); *B25G 3/06* (2013.01)

(58) Field of Classification Search

CPC . B25B 23/0028; B25B 13/462; B25B 13/481; B25B 13/48; B25B 13/5091; B25B 17/00; E21B 19/16

See application file for complete search history.

(56) References Cited

U.S. PATENT DOCUMENTS

| | | | |
|---|---|---|---|
| 174,745 | A | 3/1876 | Squire |
| 1,384,887 | A | 7/1921 | Bumdahl |

(Continued)

OTHER PUBLICATIONS

Author Unknown, picture of 3 wrenches with two labeled "STANLEY", webpage, date unknown, 1 page, publisher unknown, found on the internet Oct. 28, 2015.

(Continued)

*Primary Examiner* — Robert J Scruggs

(74) *Attorney, Agent, or Firm* — Hudak, Shunk & Farine Co. LPA

(57) ABSTRACT

A multi-functional wrench having an adjustable construction that allows the nut or bolt engaging surfaces of the wrench to be located at different angles or positions relative to a handle in order to allow the wrench to be used in otherwise difficult to reach areas. The wrench optionally includes a secondary handle removably connected to a preferably arcuate, multi-functional wrench body that is, in turn, removably connectable to a desired wrench head which includes a work-engaging fitting. The multi-functional wrench has a body that is archial or curved in shape and includes at least one drive post or ratchet and a plurality of sockets that are useful for many applications. The wrench is particularly useful to manipulate the body of straight stop and angle stop compression valves connectable to plumbing under sinks, behind toilets and inside cabinets, as well as nuts and bolts.

13 Claims, 15 Drawing Sheets

(51) Int. Cl.

| | |
|---|---|
| ***B25B 13/04*** | (2006.01) |
| ***B25B 13/08*** | (2006.01) |
| ***B25B 13/16*** | (2006.01) |

(56) References Cited

U.S. PATENT DOCUMENTS

| | | | | | |
|---|---|---|---|---|---|
| 1,400,285 | A | | 12/1921 | Hart | |
| 1,568,442 | A | | 1/1926 | Carver | |
| 1,840,685 | A | | 1/1932 | Witherup et al. | |
| 2,804,794 | A | | 9/1957 | Stang | |
| 2,830,479 | A | * | 4/1958 | Finn | B25B 17/00 74/384 |
| 3,715,937 | A | | 2/1973 | Cade et al. | |
| 4,063,475 | A | * | 12/1977 | Perkins | B25B 17/00 81/57.22 |
| 5,375,489 | A | * | 12/1994 | McClure | B25B 13/44 279/65 |
| 5,660,088 | A | * | 8/1997 | Benson | B25B 13/26 279/69 |
| 5,732,605 | A | * | 3/1998 | Mann | B25B 13/481 81/185 |
| 5,870,932 | A | | 2/1999 | Brooke | |
| 6,000,299 | A | | 12/1999 | Cole | |
| 6,832,531 | B1 | * | 12/2004 | Marquardt | B23Q 5/045 81/57.3 |
| 7,182,000 | B1 | * | 2/2007 | Dicksen | B25B 13/481 81/177.2 |
| 7,299,723 | B1 | | 11/2007 | Wessel, IV | |
| 8,353,229 | B1 | | 1/2013 | Muhareb | |
| 8,485,072 | B2 | | 7/2013 | Swing | |
| 8,820,196 | B1 | | 9/2014 | Kennedy | |
| 2002/0088314 | A1 | * | 7/2002 | Wambem | B25B 13/04 81/125.1 |
| 2004/0025646 | A1 | | 2/2004 | Hsien | |
| 2006/0288825 | A1 | * | 12/2006 | Hu | B25B 13/481 81/177.2 |

OTHER PUBLICATIONS

Author Unknown, picture of wrenches labeled 35-1 to 37-8, webpage, date unknown, 1 page, publisher unknown, found on the internet Oct. 28, 2015.

Fire Fighter Equipment Store, Akron #19 Universal Suction Spanner Wrench, webpage, date unknown, 1 page, found on the internet Oct. 28, 2015.

General Tools & Instruments, 140XL Basin Wrench Large Jaw, webpage, date unknown, 1 page, found on the internet Oct. 28, 2015.

* cited by examiner

MULTI-FUNCTIONAL WRENCH

FIELD OF THE INVENTION

The present invention relates to a multi-functional wrench having an adjustable construction that allows the nut or bolt engaging surfaces of the wrench to be located at different angles or positions relative to a handle in order to allow the wrench to be used in otherwise difficult to reach areas. The wrench optionally includes a secondary handle removably connected to a preferably arcuate, multi-functional wrench body that is, in turn, removably connectable to a desired wrench head which includes a work-engaging fitting. The multi-functional wrench has a body that is archial or curved in shape and includes at least one drive post or ratchet and a plurality of sockets that are useful for many applications. The wrench is particularly useful to manipulate the body of straight stop and angle stop compression valves connectable to plumbing under sinks, behind toilets and inside cabinets, as well as nuts and bolts.

BACKGROUND OF THE INVENTION

Ever since the existence of nuts and bolts, inventors have been creating wrenches that can be utilized to manipulate the same. Many different types and styles of wrenches are available and some antique wrenches are highly collectable based upon their fanciful constructions. Examples of various wrenches are set forth in the following documents. U.S. Pat. Nos. 174,745; 2,379,536; 1,384,887; 1,568,442; 1,840,685; 2,804,794; 3,715,937; and 5,870,932.

In spite of the large number of different styles of wrenches available, there is still a need in the art for an adjustable wrench that can be configured to access and manipulate the body of shut-off valves and nuts and bolts in difficult to reach areas, such as under sinks, behind toilets and inside cabinets where common wrenches sometimes cannot reach or create enough torque to manipulate a nut or bolt. More specifically, a wrench is needed to manipulate valve bodies or nuts on valves containing shut-off knobs and can function in tight or low clearance spaces. An adjustable wrench is needed that can approach a valve from the rear such as in the case of a straight stop valve or from a top or bottom in the case of an angle stop valve in order to make repair or installation a relatively easy task.

SUMMARY OF THE INVENTION

In view of the above noted problems, it would be desirable to provide a wrench that is adaptable and able to manipulate nuts and bolts in difficult to reach locations. The above-noted problems are solved by the multi-functional wrench according to the invention.

Another object of the present invention is to provide a multi-functional wrench having an archial body that comfortably fits the hand of a user. In some embodiments the wrench body is provided with a side surface having alternating flat and archial areas which create desirable ergonomics and allow the user to create torque necessary to adjust or manipulate a workpiece such as a nut or bolt. The design of the multi-functional wrench allows for more precise execution of tasks and longer working time.

Still another object of the present invention is to provide a multi-functional wrench having an archial body and a drive post located on each of a pair of working faces on opposite sides of the wrench, which allows for both left and right side use of the wrench.

A further object of the present invention is to provide a multi-functional wrench having an archial body having a plurality of sockets present within at least one working face of the body between a first end and a second end. In a preferred embodiment, the sockets are located on both the first working face and a second working face, with the sockets extending therethrough. In yet another embodiment, the archial body includes a central socket located substantially equal distance between first and second ends of the body. The central socket can accept a desired wrench head. In such an embodiment, the wrench can be grasped with two hands on opposite sides of the central socket in order to manipulate a work piece such as a nut or bolt. A desired wrench head can be connected, independently, to the drive post or socket of the archial body.

Still another object of the present invention is to provide a multi-functional wrench comprising a pair or more of archial bodies that are removably connected, such as end to end, utilizing the drive post of a first body and a socket of a second body. Connection of two or more archial bodies allows a user to access tight or low clearance areas, such as within an engine compartment, under a sink, or the like.

The objects of the invention are achieved by the multi-functional wrench of the invention.

Accordingly, in one aspect of the present invention a multi-functional wrench is disclosed, comprising an archial body having a first end and a second end, wherein the body has a first working face and a second working face on an opposite side of the body with respect to the first working face, wherein a drive post is present on each of the first working face and the second working face, and wherein a socket is present within each of the first working face and the second working face.

Another aspect of the present invention discloses a multi-functional wrench, comprising an archial body having a first end having a first drive post extending outwardly from a working face of the body and a second end having a socket formed in the working face of the body.

Still another aspect of the present invention discloses a multi-functional wrench, comprising a body having a first end and a second end, wherein the body has a first working face and a second working face on an opposite side of the body with respect to the first working face, wherein a drive post is present on each of the first working face and the second working face, and wherein a socket is present within each of the first working face and the second working face.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
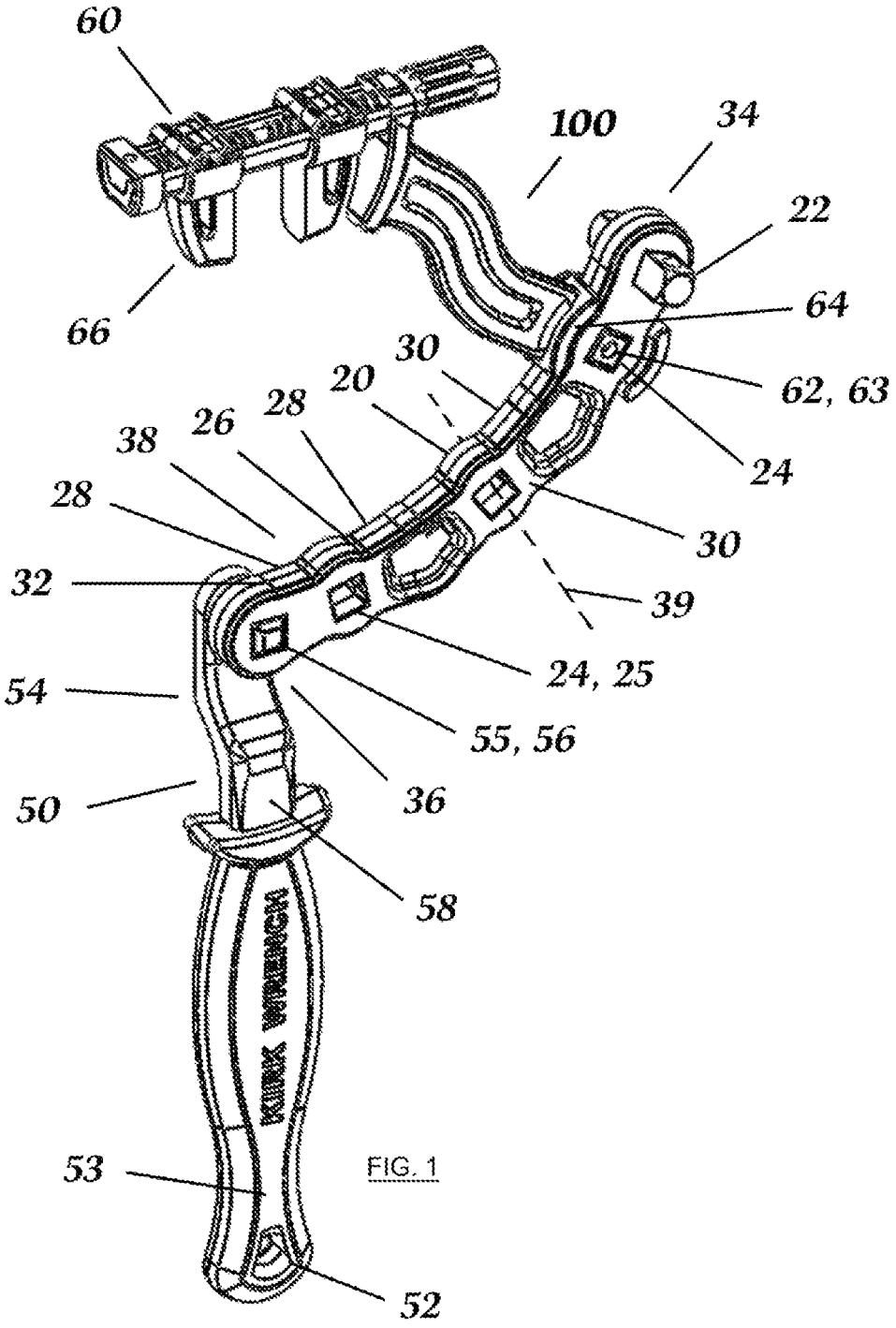
FIG. 1 is a perspective view of one embodiment of a multi-functional wrench according to the present invention including an optional secondary handle removably connected to a second end of a multi-functional wrench having an archial body and a wrench head removably connected to the archial body at a second end thereof.

This description of preferred embodiments is to be read in connection with the accompanying drawings, which are part of the entire written description of this invention. In the description, corresponding reference numbers are used throughout the several views to identify the same or functionally similar elements. Relative terms such as "horizontal," "vertical," "up," "upper", "down," "lower", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The multi-functional wrench of the present invention has a body that is archial in shape and preferably has a desirable radius of curvature, with the body including at least one drive post and/or ratchet mechanism and at least one socket. The wrench body can be utilized in combination with wide variety of wrench heads having assorted connector fittings, either male or female that can attach the wrench head to the wrench body. The design of the wrench facilitates operation in close or tight quarters. When coupled with an appropriate wrench head, the multi-functional wrench is able to approach workpieces from a variety of different angles, even from behind.

Referring now to the drawings, a multi-functional wrench 10 is illustrated in FIG. 1. Multi-functional wrench 10 has a body that is archial or curved in shape, generally between a drive end or first end 34 and a socket end or second end 36, considered with reference to a working face 30 of body 20. The degree of curvature can vary depending on application of the multi-functional wrench. The degree of curvature should be sufficient in some embodiment in order to provide one or more of the following benefits: user comfort, form that allows use of the wrench in close or tight quarters, necessary generation of torque, and precise execution of wrenching activities.

Body 20, in various figures, includes a drive post 22, preferably located at first end 34. Drive post 22 extends outwardly from working face 30. In a preferred embodiment drive post 20 is a square post which is engageable in the square socket of any of the known types of socket heads or wrenches, such as wrench head 70.

Figure 12:
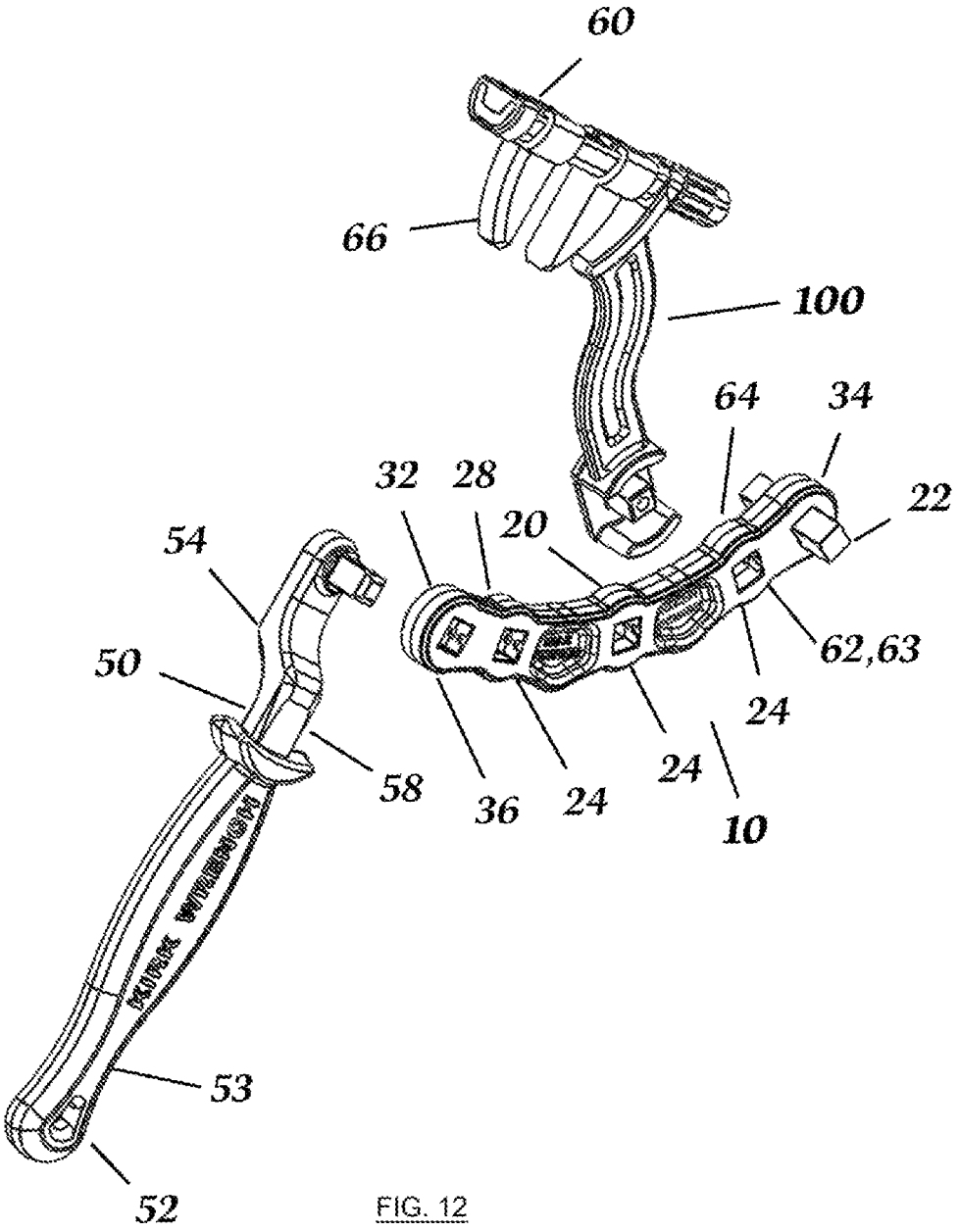
FIG. 12 is a front, exploded view showing the archial body separate from the wrench head and handle.
Figure 13:
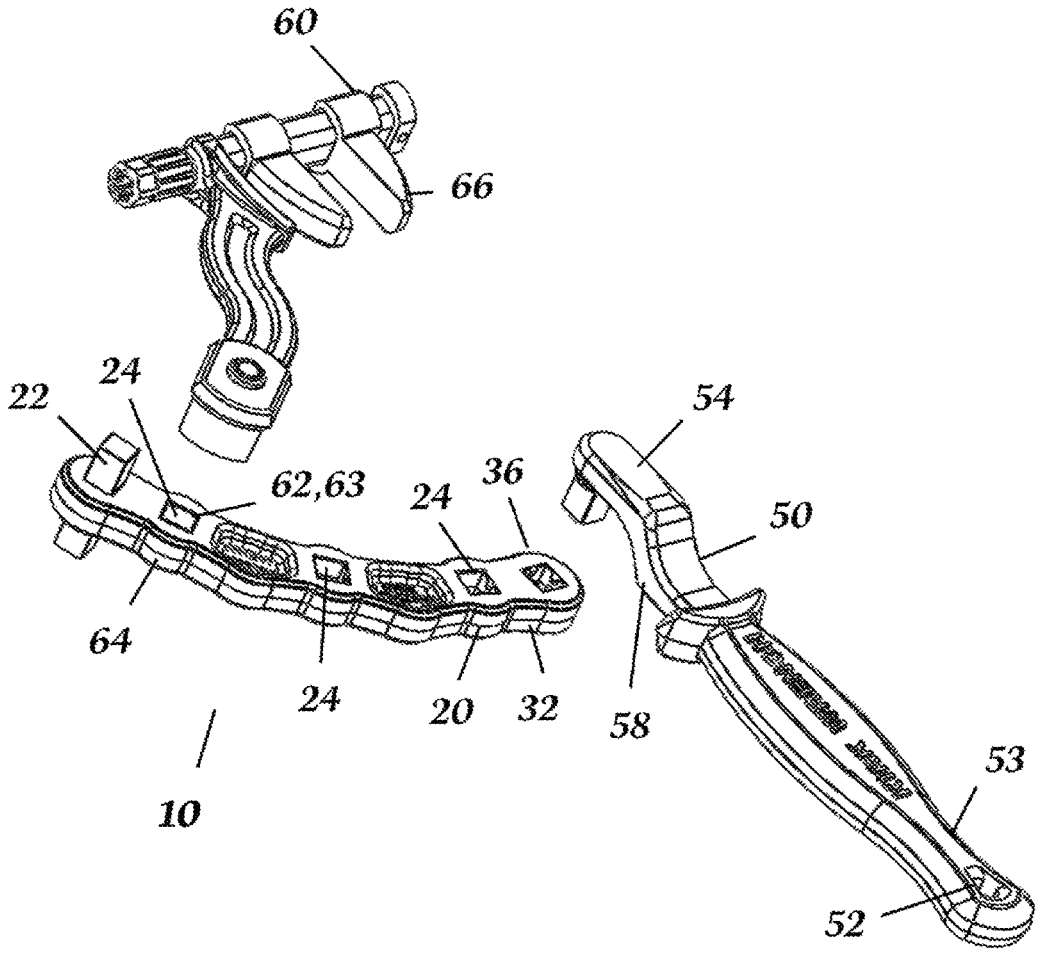
FIG. 13 is a rear view of the embodiment illustrated in FIG. 12.

In a further embodiment, as illustrated in FIGS. 12 and 13, multi-functional wrench 10 is provided with a body 10 having at least two drive posts 22. In one embodiment at least one drive post 22 is located on each working face 30. Two such drive posts 22 are illustrated in FIGS. 12 and 13. In a particularly preferred embodiment, a first drive post 22 is directly opposite, e.g. 180°, a second drive post 22 on a different working face 30 of body 20. Locating a drive post 22 on each working face allows the multi-functional wrench 10 to be utilized on either a right or left side of a particular construction or workpiece without requiring an additional wrench. By possessing two or more drive posts 22, the multi-functional wrench 10 can also be connected to a plurality of wrench heads that may be necessary to complete the desired task.

As illustrated in the figures, body 20 is also provided with one or more sockets 24. In a preferred embodiment, body 20 includes a plurality of sockets 24. While the sockets can be formed in any particular shape, preferably at least one socket and preferably all sockets 24 are square sockets and able to accept a square post present on an accessory such as a wrench head 60 shown in FIG. 1 which includes a connector fitting 62, in particular square post 63.

In some embodiments, a plurality of sockets, that is two or more, three or more, four or more, five or more, or the like, are located on a single working face 30, and spaced, independently, a desired distance from each other. Accordingly, the multi-functional wrench 10 body 20 is quite adaptable to a variety of different applications.

In one embodiment of the present invention, the body 20 includes a socket 24 in the form of an intermediate or central socket 25 that is generally centrally located between first end 34 and second end 36 of body 20. When utilized herein, the term "centrally located" with respect to the central socket means that at least a portion of the central socket falls within a centerline of the body equal distance between the first end and second end of the body.

Body 20 of multi-functional wrench 10 includes a pair of sides 32 located between the two working faces 30. The sides 32 can be provided with one or more ribs 26 and one or more flat or substantially flat areas 28. A combination of ribs and flats have been found to provide excellent grip to the wrench 10. The second end 36 of body 20 serves as a handle 38 in one embodiment of multi-functional wrench 10. The first end 34 can also serve as a handle for example when central socket 35 is fitted with a wrench head. As such, both ends 34, 36 of body 20 can be grasped by the user to provide an actuating force to the wrench 10.

As illustrated in FIG. 1, the sockets 24 of body 20 preferably extend completely therethrough such that a socket 24 on one working face 30 is present as a socket 24 on the opposite working face.

As shown in FIG. 1, wrench head 60 having adjustable jaw 66 includes a connector fitting 62 comprising a square post 63 that is mateable and removable from socket 24. Wrench head 60 is also provided with a secondary fitting 64 in the form of a groove or depression at the end where wrench head 60 is connected to wrench body 20 with the groove or depression mating with rib 26 and areas adjacent thereto in contact with or generally adjacent flat 28 of body 20. Such a construction including the two different types of fittings ensures that wrench head 60 is securely yet removably joined to wrench body 20. FIG. 1 also illustrates optional secondary handle 50 that can be connected to body 20. Secondary handle 50 includes a grip end 52 including a hand grip 53 and a connector fitting end 54 including a connector fitting 55, and post 56, as illustrated. Intermediate section 58 is located between the connector fitting end 54 and grip end 52 and can vary in length as to desired in order to provide the multi-functional wrench 10 with a desired configuration.

Figure 2:
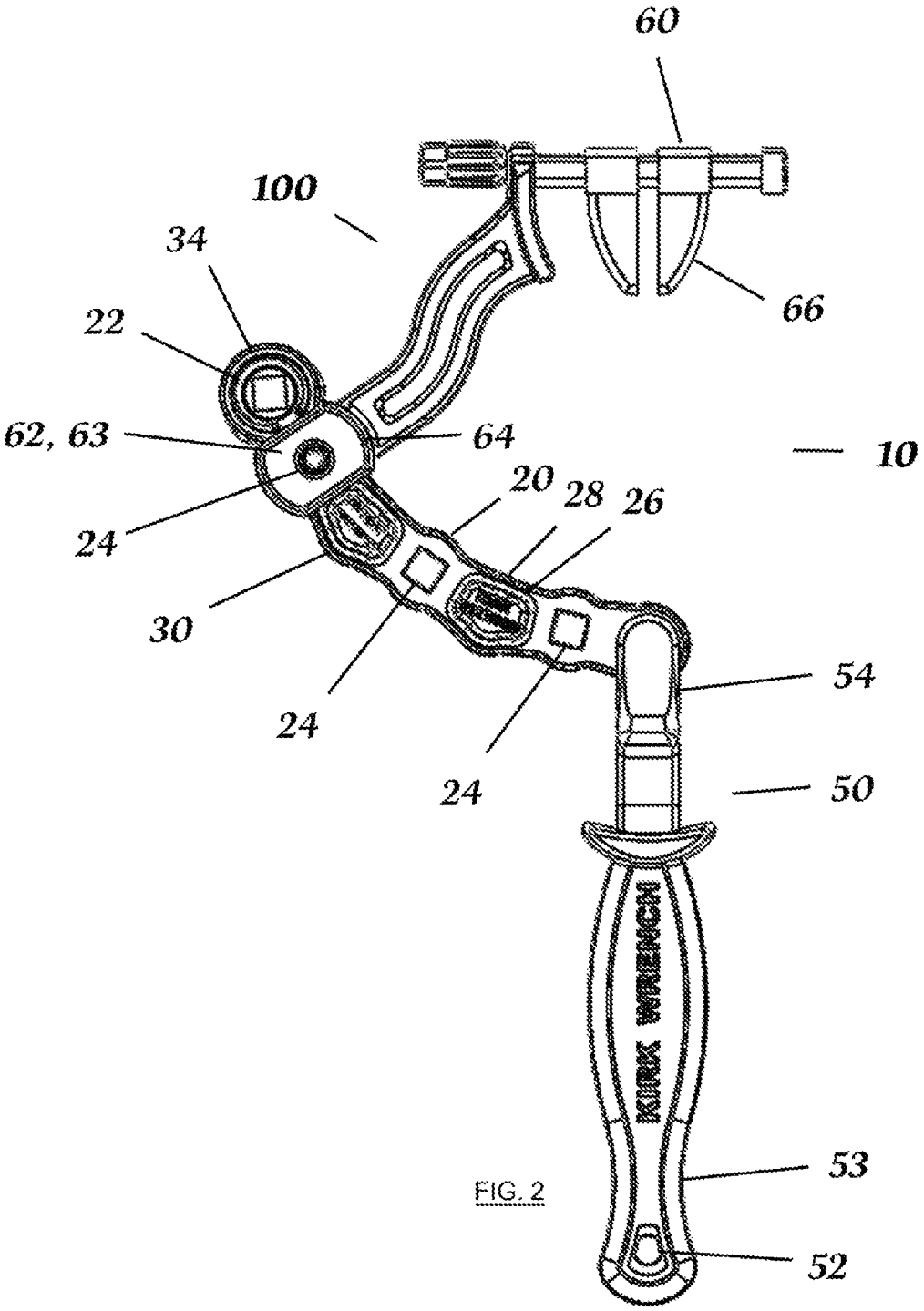
FIG. 2 is a rear view of a further embodiment of a multi-functional wrench.
Figure 3:
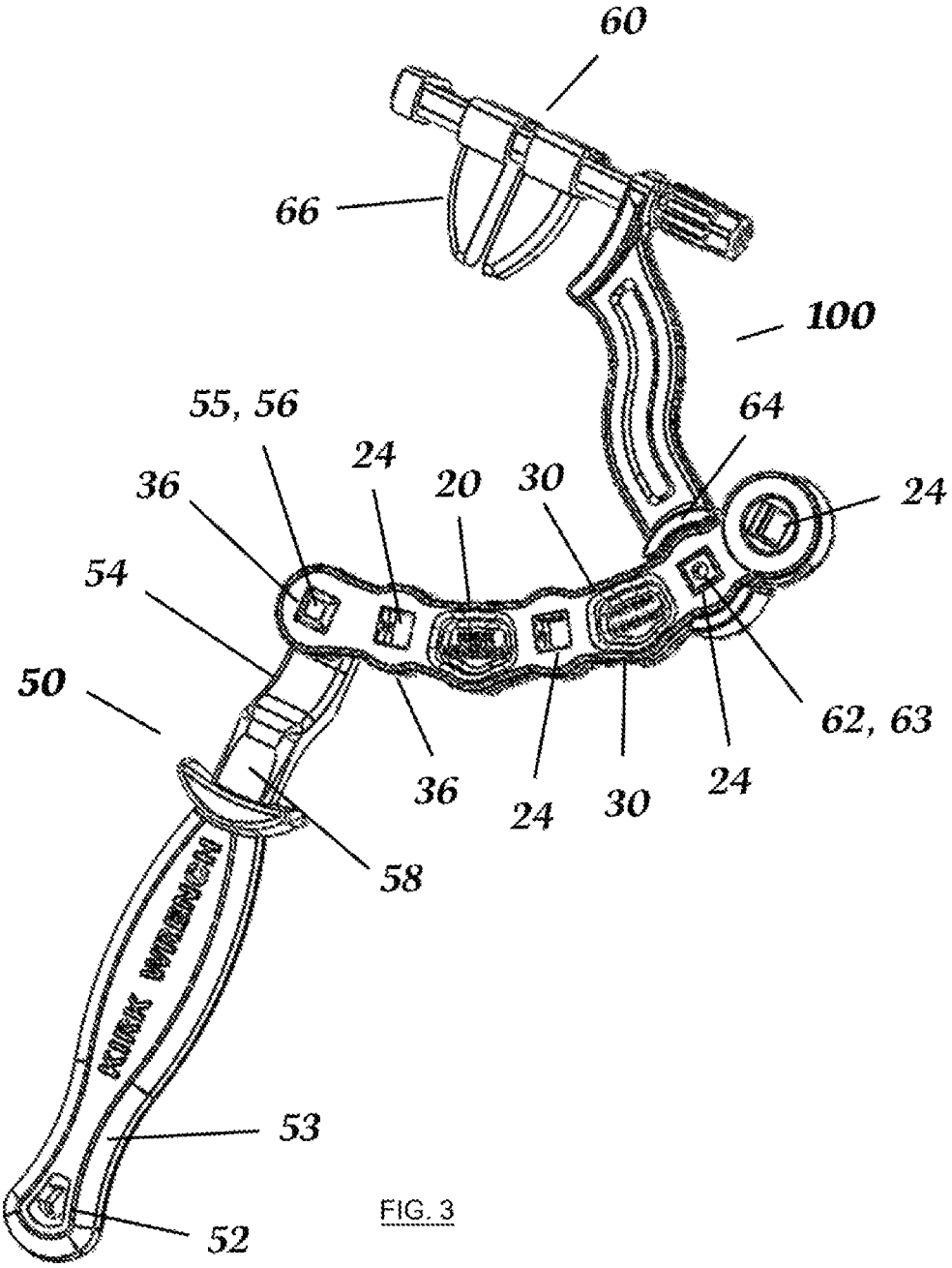
FIG. 3 is a front view of a further embodiment of a multi-functional wrench, wherein the ability to approach a workpiece from the opposite side as compared to FIG. 2 is shown.

FIG. 2 is a rear view of the embodiment illustrated in FIG. 1 showing the ability of the multi-functional wrench 10 to approach a workpiece from the opposite side as compared to FIGS. 1 and 3, with FIG. 3 being a front view of the embodiment shown in FIG. 1.

Figure 4:
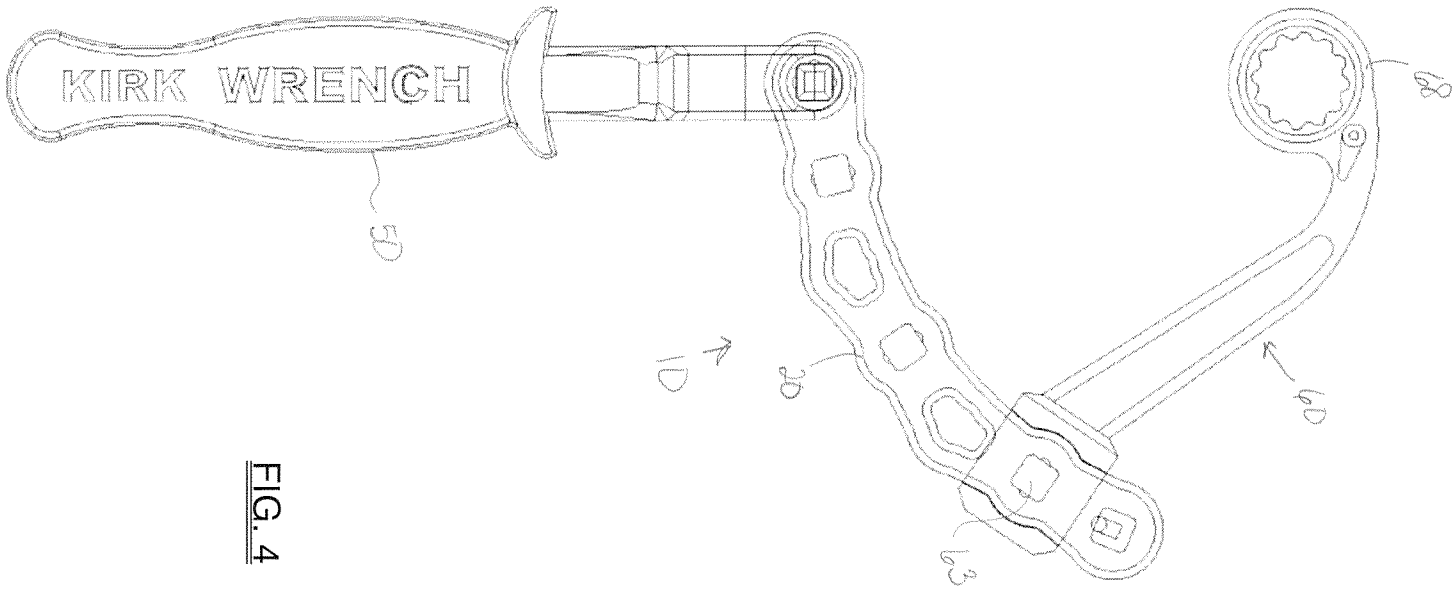
FIG. 4 shows a front view of a further embodiment of a multi-functional wrench according to the present invention including a ratcheting wrench head connected to the archial body.

FIG. 4 illustrates a further embodiment of multi-functional wrench 10 of the present invention including a wrench head 60 including a ratchet mechanism 68.

Figure 5:
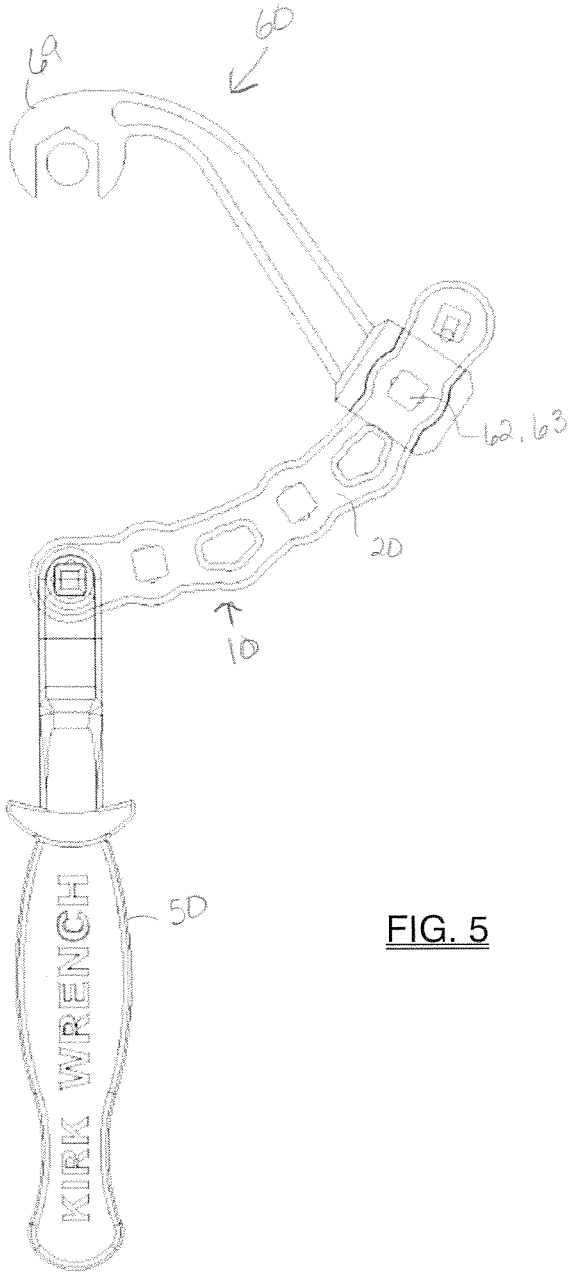
FIG. 5 shows a front view of a further embodiment of a multi-functional wrench according to the present invention including an open-end wrench connected to the archial body.

FIG. 5 illustrates a further embodiment of multi-functional wrench 10 of the present invention including a wrench head 60 including an open end wrench 69.

Figure 6A:
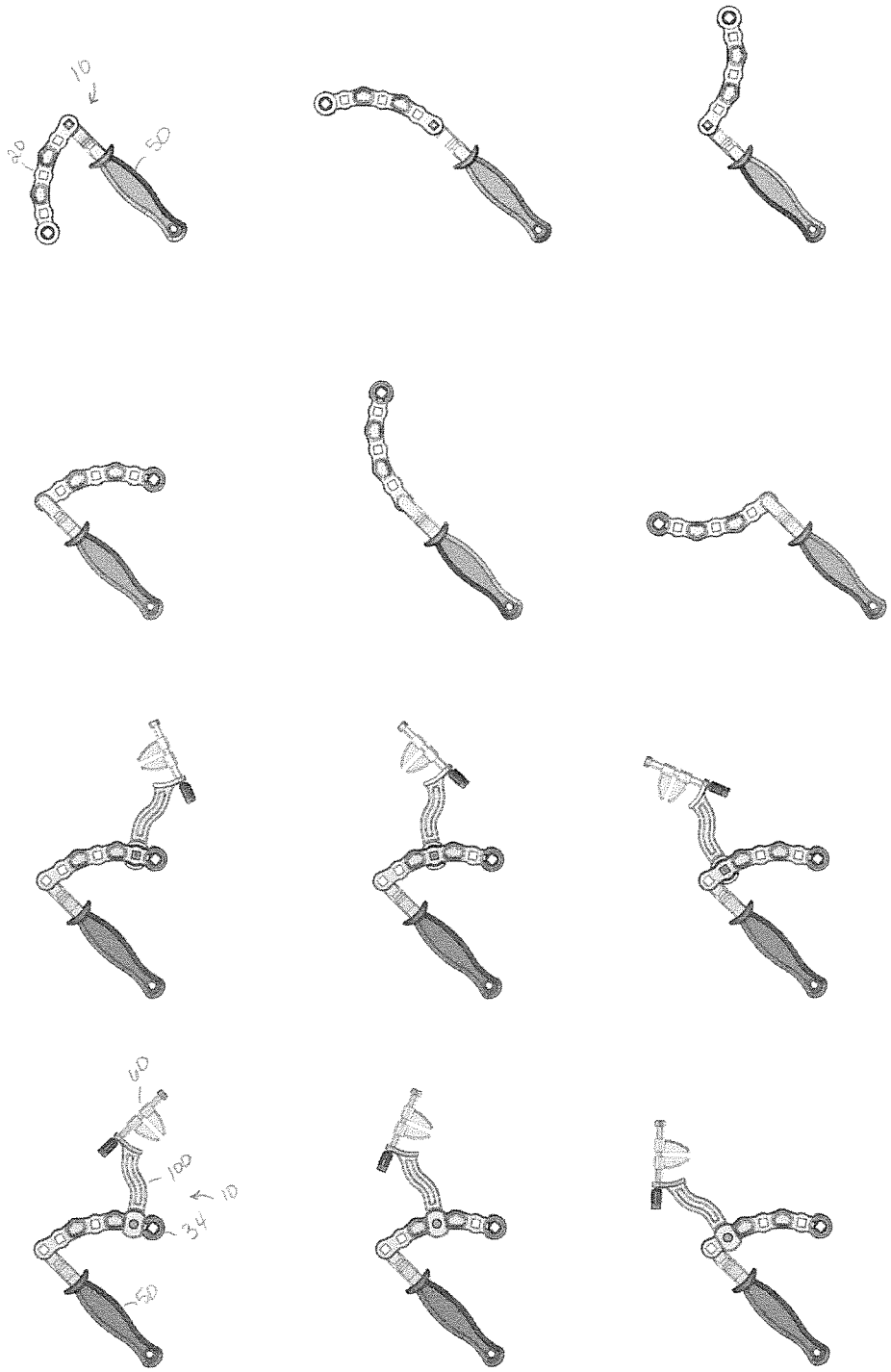
FIGS. 6A, 6B, and 6C illustrate the adjustability of the wrench including the archial body of the present invention connected to the secondary handle and wrench head at different locations on the body utilizing the available fittings thereof including the drive post and sockets.
Figure 6B:
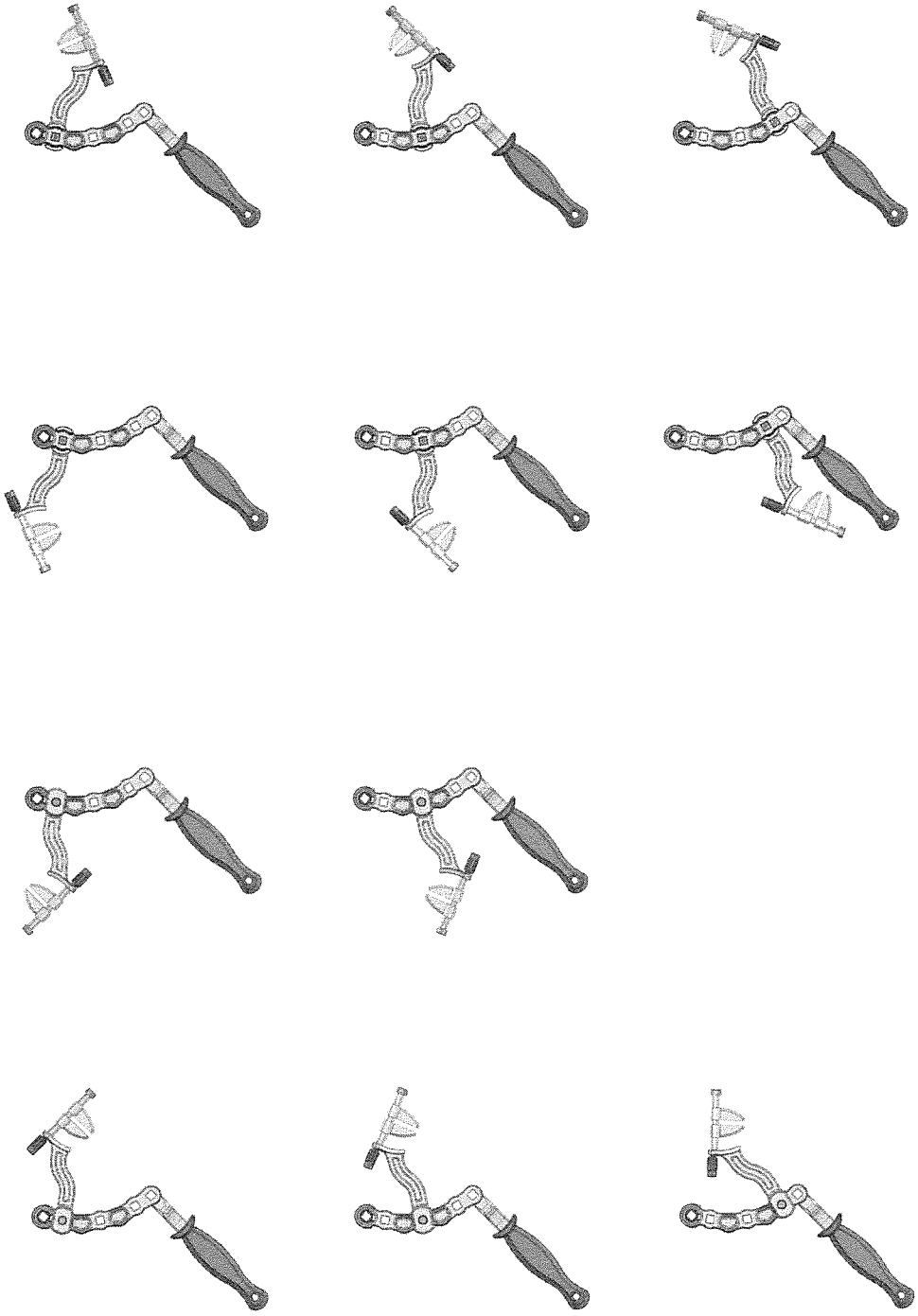
Figure 6C:
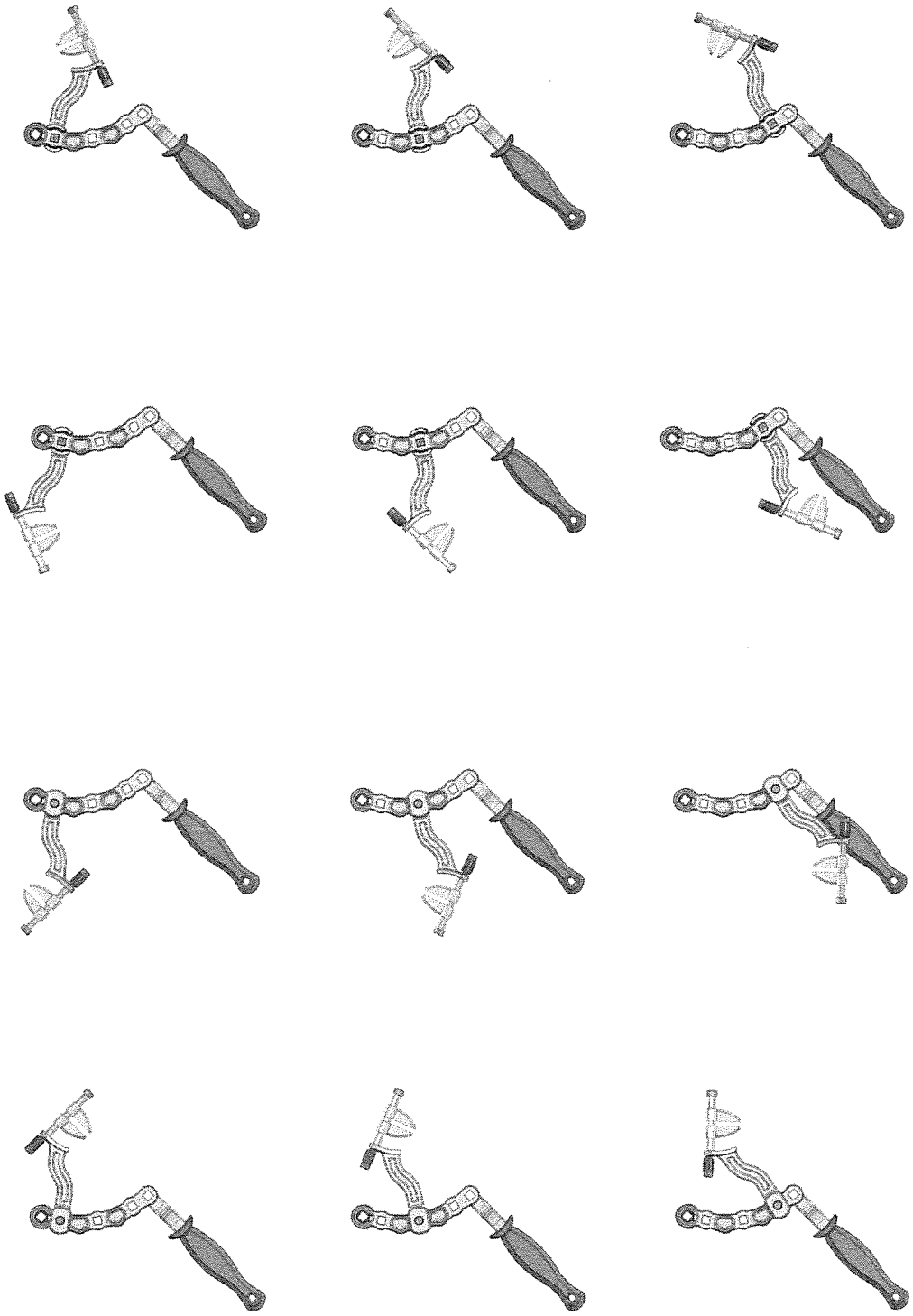

FIGS. 6A, 6B, and 6C present a series of images showing a wrench head 60 being connected to body 20 at a plurality of different locations thereon. Thus, multi-functional wrench 10 can be configured in many ways and applied under many different circumstances and situations.

Figure 7:
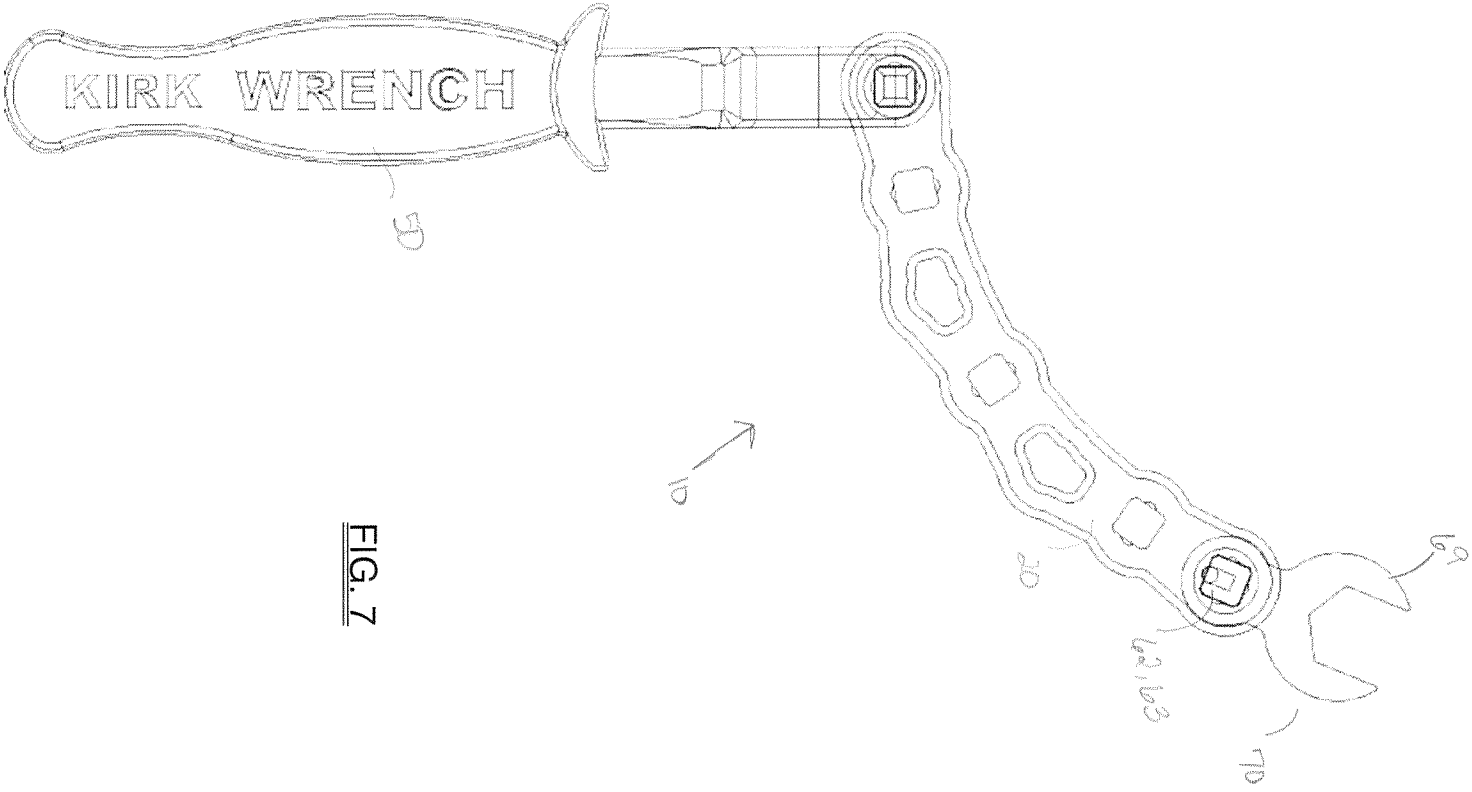
FIG. 7 shows a top view of a further embodiment of a multi-functional wrench according to the present invention including an open-end wrench connected to the archial body.
Figure 8:
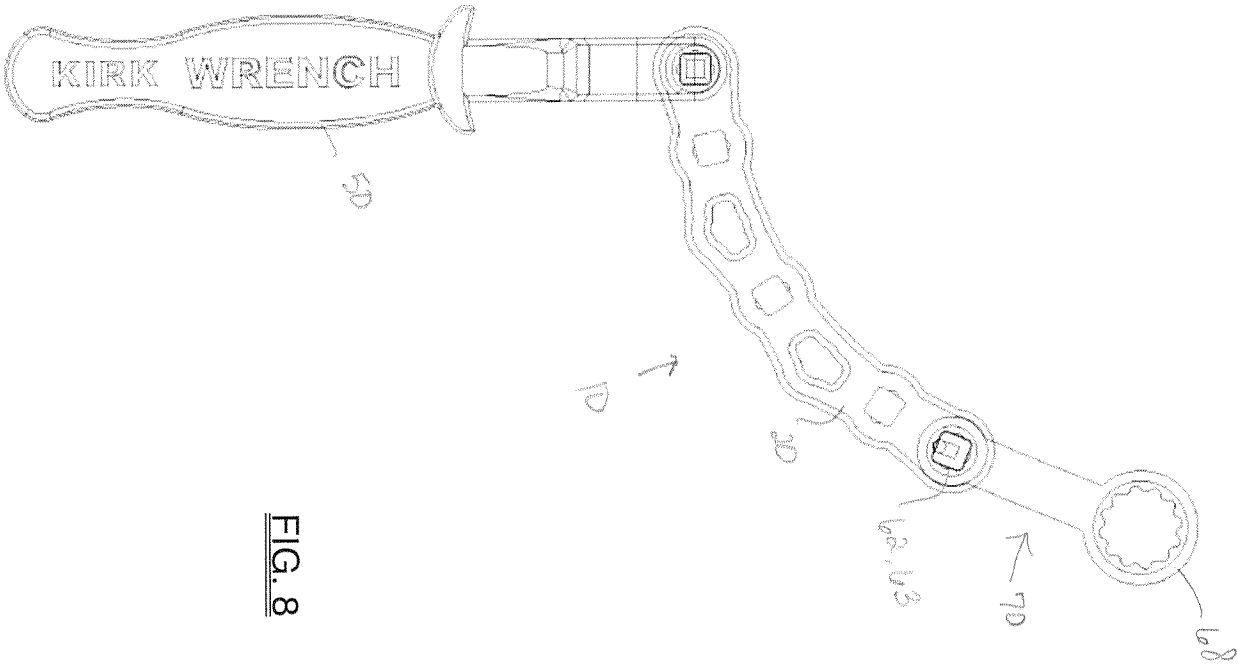
FIG. 8 shows a top view of a further embodiment of a multi-functional wrench according to the present invention including a ratcheting wrench head connected to the archial body.

FIGS. 7 and 8 show a further embodiment of a multi-functional wrench 10 according to the present invention including different styles of a ratcheting mechanism 68 and open end wrench 69, wherein wrench head 70 includes a socket at one end that is connected to drive post 22 of body 20.

Figure 9:
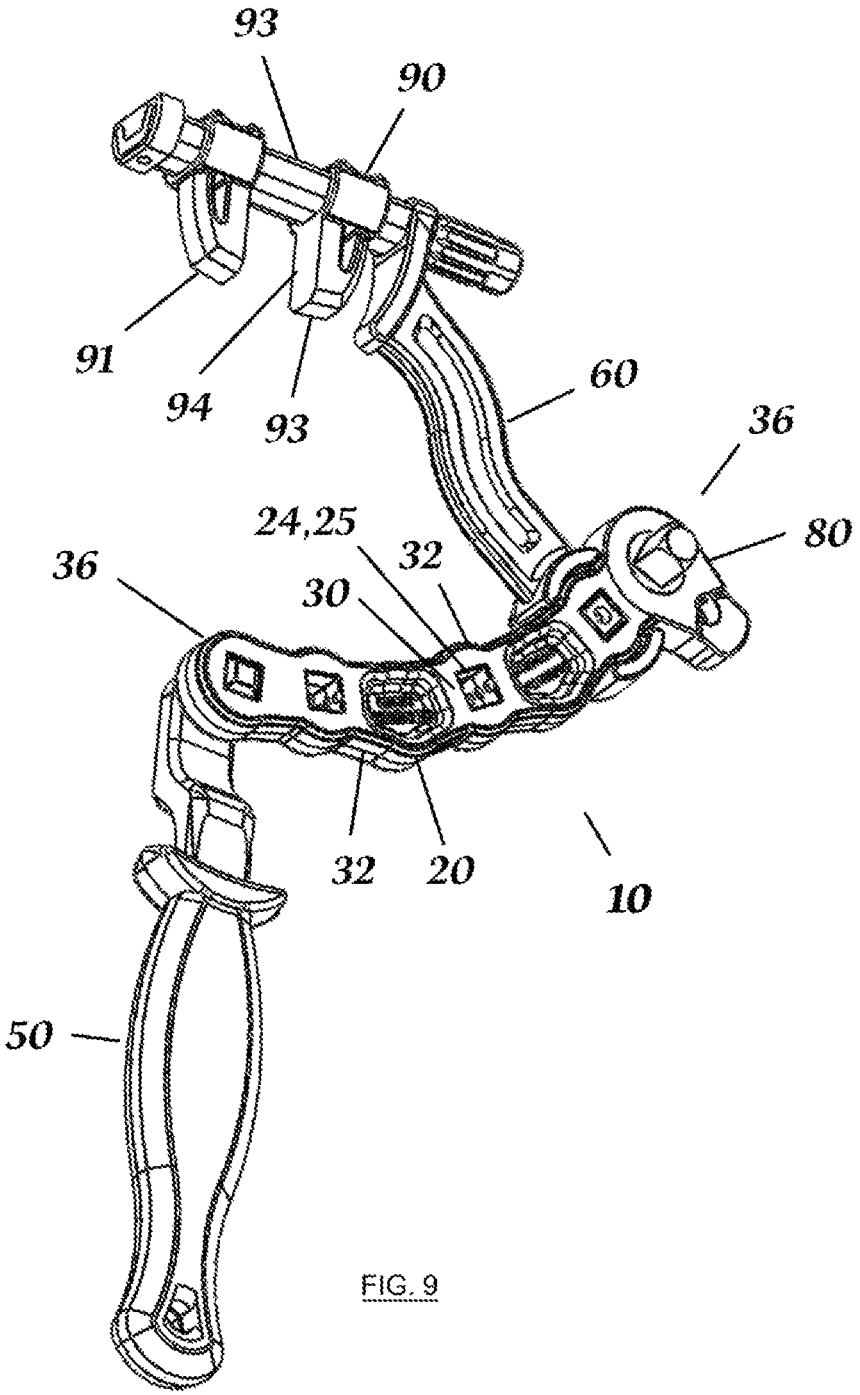
FIG. 9 shows a front perspective view of a further embodiment of a multi-functional wrench according to the present invention including an optional secondary handle removable connected to a second end of the multi-functional wrench having an archial body, a ratchet mechanism attached to a second end of the archial body, and wrench head having self centering jaw, the wrench head operatively connected to the archial body adjacent the ratchet mechanism.

FIG. 9 illustrates a further embodiment of a multi-functional wrench of the present invention, with the primary construction thereof being similar to the multi-function wrench illustrated in FIG. 1. However, in FIG. 9, the first end or drive end 34 includes a ratchet mechanism 80. The ratchet mechanism 80 has a drive system that allows continuous rotary drive motion in only one direction, while preventing a drive motion in the opposite direction. When turned in the opposite direction, the ratchet does not turn the drive, but allows the wrench to be repositioned for another turn while staying attached to the object that is acted upon. The ratcheting mechanism allows rapid manipulation of the drive, a drive head attached thereto and a component operatively connected to the ratcheting mechanism in small increments without requiring the drive head to be disconnected from the component being worked upon. In one preferred embodiment, a switch is built into the ratchet mechanism that allows the user to apply the ratcheting action in either direction, as needed to tighten or loosen the component being worked on. The ratchet mechanism includes a round gear and a pivoting, spring loaded pawl that engages the teeth of the gear. The teeth are shaped as desired to allow forward movement and restrict backward movement, as known in the art.

Figure 10:
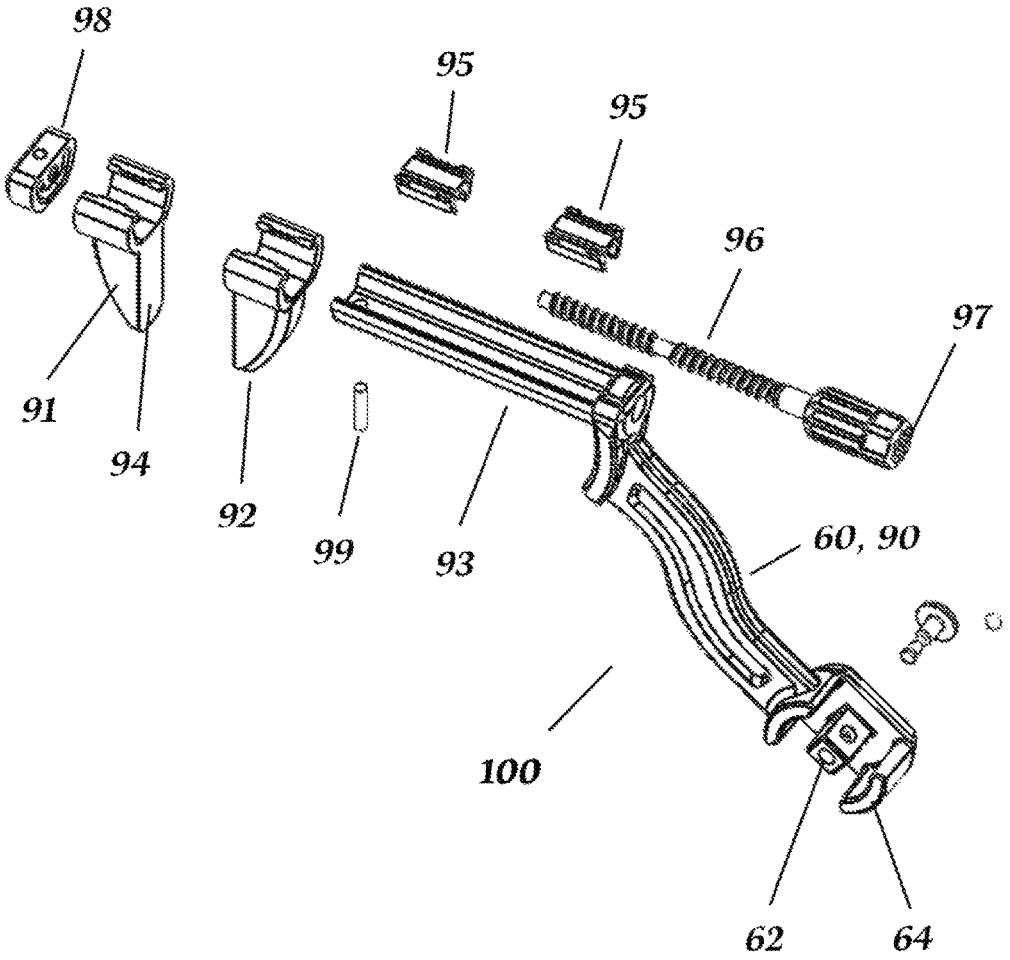
FIG. 10 is an exploded view of the wrench head illustrated in FIG. 9.
Figure 11:
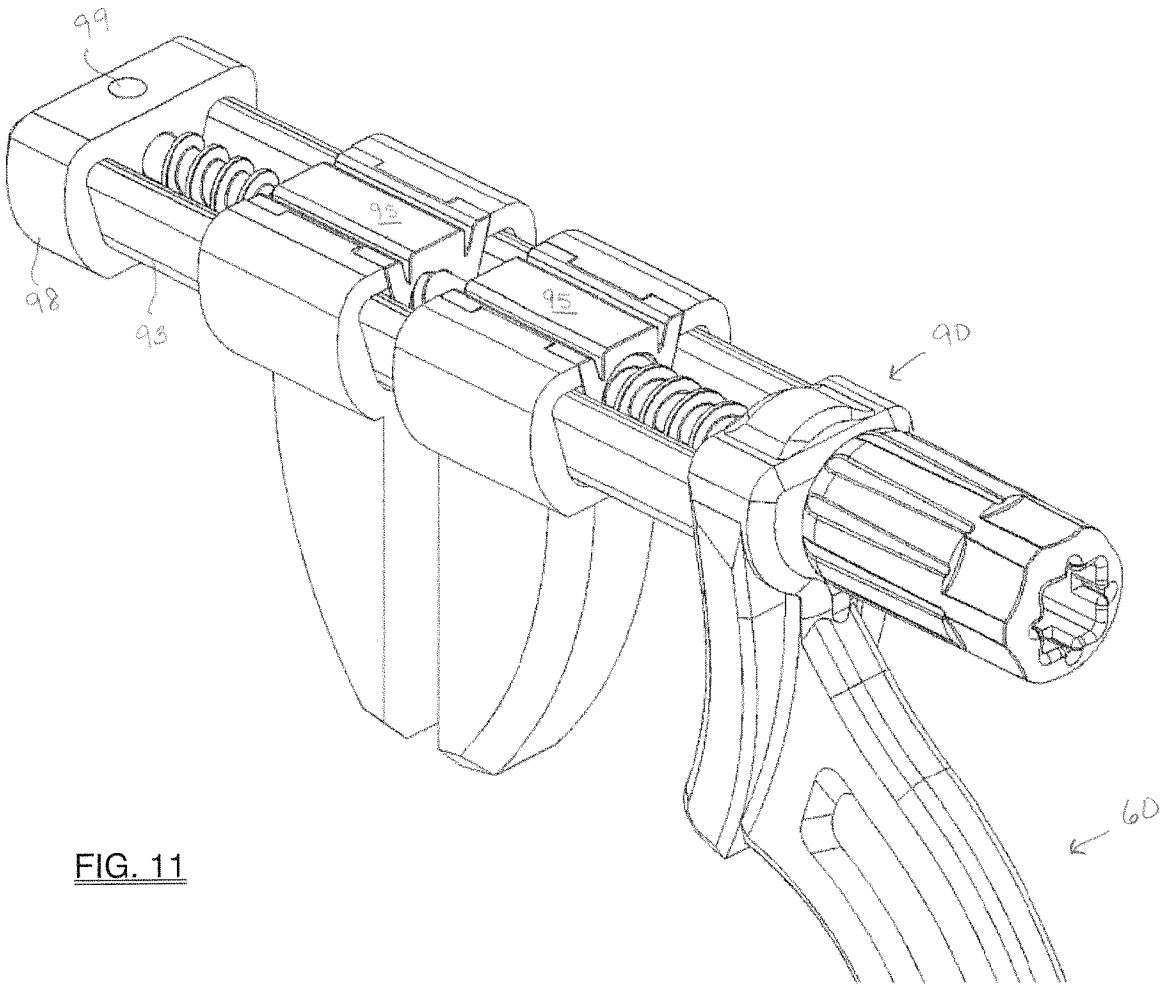
FIG. 11 is a slightly downward-looking perspective view of a portion of the wrench head shown in FIGS. 9 and 10.

Wrench head 60 illustrated in FIGS. 9-11 includes a self-centering wrench head 90 which includes a first jaw 91 and a second jaw 92 that are moveable in opposite directions along track 93. The length of track 93 is sufficient to provide a desired maximum clearance between the inner end faces 94 of the first and second jaws 91, 92. Each jaw includes a fitting engagable with track 93 such that the jaw can be moved along a length thereof with the jaw being operatively connected to the guide or track 93. Wrench head 90 also includes a worm screw 96 that is mateable with key 95 of each jaw 91 and 92. Worm screw 96 includes two sets of continuous teeth journaled in opposite directions so that the jaws 91, 92 can be moved in opposite directions from each other when the worm screw 96 is manipulated such as by a user, or by a tool using worm screw key or knob 97. In one embodiment, the worm screw key or knob 97 is configured to accept one or more of a square drive post, straight bit and a Phillips-type bit implement. Wrench head 90 also includes a track end fitting 98 secured to the track by any suitable means such as a fastener or pin 99 which extends through a portion of the track 93 and the track end fitting 98. Manipulating the worm screw 96 in a first direction will bring the jaws closer together, whereas moving the worm screw in the opposite direction will separate the jaws.

Wrench head 90 is self-centering in the sense that the jaws 91, 92 meet at substantially the center of track 93, as opposed to one of the jaws being fixed at one end of the track and the remaining jaw adjustable in relation thereto. As illustrated in FIG. 9, the jaws 91, 92 are also in line with an axis formed by the longitudinal axis of secondary handle 50. The jaws 91, 91 preferably face the secondary handle 50 in one embodiment. The jaws 91, 92 are disposed on the same side of the wrench head 90 as the handle 100, and generally face the same direction as the user, as shown in FIG. 9. This particular arrangement facilitates alignment and manipulation of nuts in difficult to reach areas. The wrench head has jaws that are removable/interchangeable which enables the user to interchange different jaw types easily and quickly. The snap-in clips 95 that hold the jaws in place are removable and reusable. The clips 95 are also indexed the same as the worm gear which holds the worm gear in place and provides for the adjustment of the jaws. Track end fitting 98 is also removable by removing the coil pin 99. The arm of the wrench 100 is at an angle which keeps the jaw centerline directly inline with the handle when in the primary position. The jaws 91,92 travel on the track 93 in such a way that, when engaging the work surface, the points that meet the bottom of the track and the top of the track at opposite corners lock the jaws in place. Unlike standard adjustable wrenches, the track 93 is unique because of the low clearance which enables the user to get into tight spaces and reach behind valves bodies when close to walls or back of cabinets. The worm gear knob 97 is located at the end of wrench instead of the top for easy access in tight spaces, unlike some standard adjustable wrenches which are located on the top of the wrench. So, when the wrench is being used in hard to reach areas, the wrench can still be adjusted without removing it from the workspace. Another unique feature about the knob structure and position is that if the user does not have access in tight spaces to turn the knob with his hand he can insert a Phillips, square drive or nut driver in the end of the knob to turn the knob and manipulate the jaws.

In one embodiment the self-centering wrench head 90 includes a handle 100 of any desired length and has a connector fitting 62 attached at one end thereof. In the embodiment shown in FIG. 10, the connector fitting is a square post. Wrench head 90 also includes a secondary fitting 64 in the form of a groove or depression at the end where wrench head 90 is connected to wrench body 20, with the groove or depression mating with a rib 26 and areas adjacent thereto in contact with or generally adjacent flat 28 of the body 20.

In accordance with the patent statutes, the best mode and preferred embodiment have been set forth; the scope of the invention is not limited thereto, but rather by the scope of the attached claims.

What is claimed is:

1. A multi-functional wrench, comprising:

an archial body having a first end and a second end, wherein the body has a first working face and a second working face on an opposite side of the body with respect to the first working face, wherein the body has an integral drive post extending outwardly from each of the at least one of the first working face and the second working face, wherein a socket is present in the body and extends completely through the body between each of the first working face and the second working face, wherein the socket comprises an intermediate socket centrally located between the first end and the second end of the body, wherein the body is curved along a plane in shape between the first end and second end with reference to the first working face of the body such that the intermediate socket is located outside of a straight line drawn between the first end and the second end, and wherein the drive post on the first working face is directly opposite the drive post on the second working face.

2. The multi-functional wrench according to claim 1, wherein the drive posts are located at the first end of the body.

3. The multi-functional wrench according to claim 2, wherein a plurality of the sockets are present in the body and are located between the drive posts and the second end of the body.

4. The multi-functional wrench according to claim 3, wherein the drive posts comprise a square post, and wherein the sockets are square apertures.

5. The multi-functional wrench according to claim 1, wherein a side of the body between the first working face and the second working face includes an archial segment located adjacent to at least one of the sockets.

6. The multi-functional wrench according to claim 1, further including a wrench head removably connectable to one or more of the drive post, the socket of the first working face, and the socket of the second working face.

7. The multi-functional wrench according to claim 6, wherein the wrench head includes a wrench head connector fitting disposed at a first end of the wrench head, wherein the wrench head has a second end including a pair of jaws, a ratcheting mechanism, a hex bit, a torque bit, a Phillips bit, or a flat bit.

8. The multi-functional wrench according to claim 1, wherein the multi-functional wrench further includes a handle having a grip end and a connector fitting end with a post connectable to one of the sockets of the archial body, and wherein the handle has an intermediate section located between the grip end and the connector fitting end.

9. The multi-functional wrench according to claim 1, further including a centering wrench head operatively connected to the body.

10. A multi-functional wrench, comprising:

an archial body having a first end and a second end, wherein the body has a first working face and a second working face on an opposite side of the body with respect to the first working face, wherein the body has an integral ratchet mechanism on at least one of the first working face and the second working face at the second end of the body, and wherein a plurality of sockets are present in the body and extend completely through the body between each of the first working face and the second working face and are located between the ratchet mechanism and the second end of the body, wherein an intermediate socket is present and centrally located between the first end and the second end of the body, wherein the body is curved along a plane in shape between the first end and second end with reference to the first working face of the body such that the intermediate socket is located outside of a straight line drawn between the first end and the second end.

11. The multi-functional wrench according to claim 10, wherein a side of the body between the first working face and the second working face includes an archial segment located adjacent to at least one of the sockets.

12. The multi-functional wrench according to claim 10, wherein the ratchet mechanism has a drive system that allows a continuous rotary drive motion in only one direction, while preventing a drive motion in the opposite direction.

13. A multi-functional wrench, comprising:

an archial body having a first end and a second end, wherein the body has a first working face and a second working face on an opposite side of the body with respect to the first working face, wherein the body has an integral drive post extending outwardly from at least one of the first working face and the second working face, wherein a socket is present in the body and extends completely through the body between each of the first working face and the second working face, wherein the socket comprises an intermediate socket centrally located between the first end and the second end of the body, wherein the body is curved along a plane in shape between the first end and second end with reference to the first working face of the body such that the intermediate socket is located outside of a straight line drawn between the first end and the second end, and wherein the drive post comprises a square post, and wherein the socket is a square aperture.

* * * * *